United States Patent [19]

Nakahara et al.

[11] Patent Number: 4,574,576

[45] Date of Patent: Mar. 11, 1986

[54] TENSION DEVICE

[75] Inventors: Teiji Nakahara, Uji; Toshinori Shibao; Kazuyuki Fujiwara, both of Kameoka, all of Japan

[73] Assignee: Murata Kikai Kabushiki Kaisha, Japan

[21] Appl. No.: 528,118

[22] Filed: Sep. 1, 1983

[30] Foreign Application Priority Data

Sep. 7, 1982 [JP] Japan ..... 57-136244[U]

[51] Int. Cl.[4] ..... D01H 7/86; D01H 13/10; B65H 59/10

[52] U.S. Cl. ..... 57/58.86; 57/352; 242/147 R; 242/147 M; 242/150 M

[58] Field of Search ..... 242/147 R, 147 M, 150 M, 242/150 R; 57/58.87, 58.86, 352

[56] References Cited

U.S. PATENT DOCUMENTS

| | | | |
|---|---|---|---|
| 2,751,166 | 6/1956 | Beyer | 57/58.86 X |
| 2,785,526 | 3/1957 | Keith | 57/58.86 |
| 4,363,207 | 12/1982 | Fukunaga | 57/58.86 |
| 4,423,587 | 1/1984 | Inoue | 57/58.86 |

*Primary Examiner*—John Petrakes

*Attorney, Agent, or Firm*—Spensley Horn Jubas & Lubitz

[57] ABSTRACT

A ring tenser for a twisting machine. The ring is loosely fitted from above a head portion of the tenser body having a shoulder formed on an outer circumferential surface thereof and is placed on the shoulder of the tenser body so that a yarn unwound from a package is passed between the ring and the shoulder. One of the head portion of the tenser body and the ring is made of a metal material while the other includes a magnet.

16 Claims, 3 Drawing Figures

TENSION DEVICE

BACKGROUND OF THE INVENTION

This invention relates to a ring tenser used in a twisting machine or the like for applying appropriate tension to a yarn when it is unwound from a yarn supply package.

In such ring tensers, a slightest difference in weight will have a significant effect on characters of a yarn produced. Accordingly, selection of a ring employed in such ring tensers is done with care. In consideration of these circumstances, normally a structure is employed which facilitates replacement of a ring so that a ring may be promptly exchanged for another ring in accordance with characters of a yarn to be processed and so on.

The present invention has thus been made to eliminate such troubles that the ring is accidentally dropped or lost and so on in operation of a conventional ring tenser which may often occur during exchanging operations of a ring. Details of such troubles will become apparent from the following description of a prior art structure given in connection with FIGS. 1 and 2.

SUMMARY OF THE INVENTION

This invention relates to a tension device used in a twisting machine, specifically, in a two for one twisted for applying appropriate tension to a yarn when it is unwound from a yarn supply package.

An object of the present invention is to provide an improved tenser device in which troubles in operation can be eliminated.

In the present invention, a ring renser of the type wherein a ring is loosely fitted from above a head portion of a tenser body having a shoulder formed on an outer circumferential surface thereof and is placed on the shoulder of the tenser body such that a yarn unwound from a package is passed between the ring and the shoulder of the tenser body in order to apply tension to the yarn, is characterized in that one of the head portion of the tenser body and the ring is made of a metal material while the other includes a magnet.

According to the present invention, a ring tenser can be readily handled without suffering from such a trouble that a ring is accidentally dropped or lost, thereby contributing to improvement of operating properties thereof.

DETAILED DESCRIPTION OF THE DRAWINGS

Figure 1:
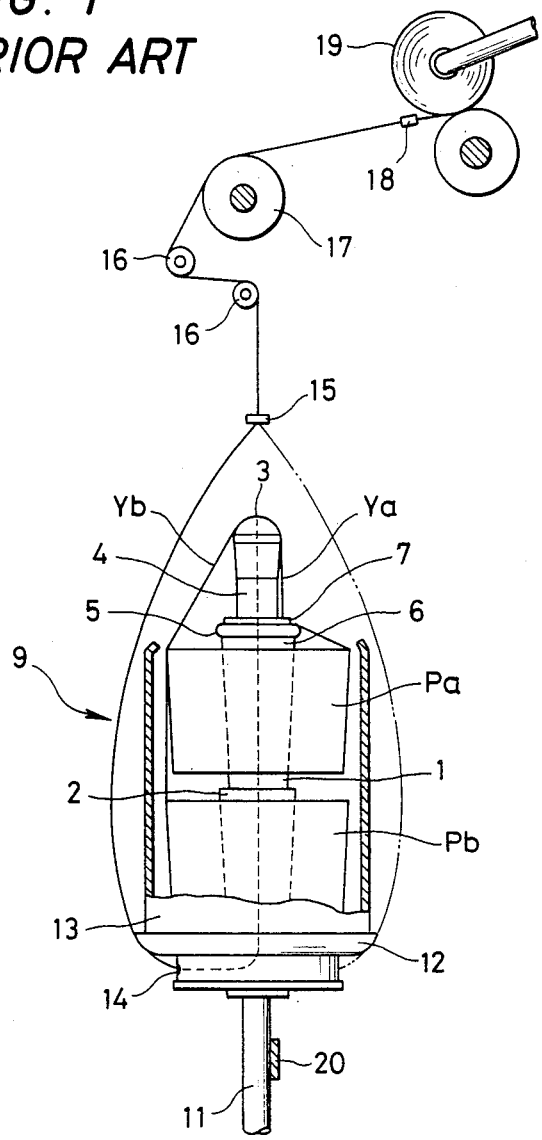
FIG. 1 PRIOR ART
FIG. 1 is a view showing a general construction of a two for one twister which employs a conventional tenser member.

FIG. 1 illustrates an example of a conventional two for one twister wherein a tapered core pipe of an upper package Pa and a tapered core pipe of a lower package Pb are removably disposed in coaxial contiguous relationship and a tenser member 4 having a yarn introducing hole 3 formed at the top thereof is placed, at a flange 5 thereof, on a larger diameter portion 6 of the core pipe of the upper package Pa. A ring 7 is placed on the flange 5 of the tenser member 4 as seen from FIG. 2, and a upper supply yarn Ya from the upper package Pa is passed between the flange 5 and the ring 7 thereon. The inner diameter of the ring 7 is considerably larger than the outer diameter of a head portion 8 of the tenser member 4 so that the ring 7 can be loosely fitted onto and removed from the tenser member 4 from and to above the head 8 of the tenser member 4.

The two for one twister 9 which twists an upper supply yarn Ya and a lower supply yarn Yb drawn from the upper package Pa and the lower package Pb, respectively, includes a stationary disk 13 placed on a rotary disk 12 which in turn is secured to a spindle 11, as shown in FIG. 1. Even during rotation of the rotary disk 12, the stationary disk 13 is held in a stationary condition due to a magnetic force acting between a magnet (not shown) on the stationary disk 13 and another cooperating magnet. Each of the rotary disk 12 and the stationary disk 13 has, formed at the center thereof, a yarn passing hole (not shown) which communicates with a yarn outled hole 14 formed in the rotary disk 12. Thus, the upper supply yarn Ya from the upper package Pa passes the ring 7 and extends to the yarn inlet hole 3 of the tenser member 4 while the lower supply yarn Yb from the lower package Pb extends directly to the yarn inlet hole 3 through which both yarns Ya and Yb are admitted into the yarn passing holes of the rotary disk 12 and the stationary disk 13 and are then led out from the yarn outlet hole 14 so that they may be twisted together. The thus twisted Yarn Y is then guided by a yarn guide 15, a guide roller 16, a feed roller 17 and a traverse guide 18 and is taken up on a winding package 19.

Reference numeral 20 designates a drive belt for driving the spindle 11 to rotate.

Problems in connection with exchanging of a ring 7 in such prior art structure as described above will be given below. In order to exchange the ring 7, it must at first be removed from the head portion 8 of the tenser member 4. But the ring 7 may occasionally drop from an operator's hand in error and be hidden to the depth within the two for one twister. Further, in some other cases, the tenser member 4 itself may be removed in order to check if it functions well or not. In such cases, care must be taken because a slighest inclination of the tenser member 4 might cause the ring 7 to be readily let off the tenser member 4. Thus, it is very troublesome that care must always be taken when a ring 7 is to be exchanged, and besides, a dropped ring could not be picked out during running of the two for one twister without a risk.

The present invention has been thus made in view of the above described circumstances and contemplates elimination of the problems of such a prior art structure by improving a ring tenser thereof.

In the followings, a preferred embodiment of the invention will be described in detail.

Figure 2:
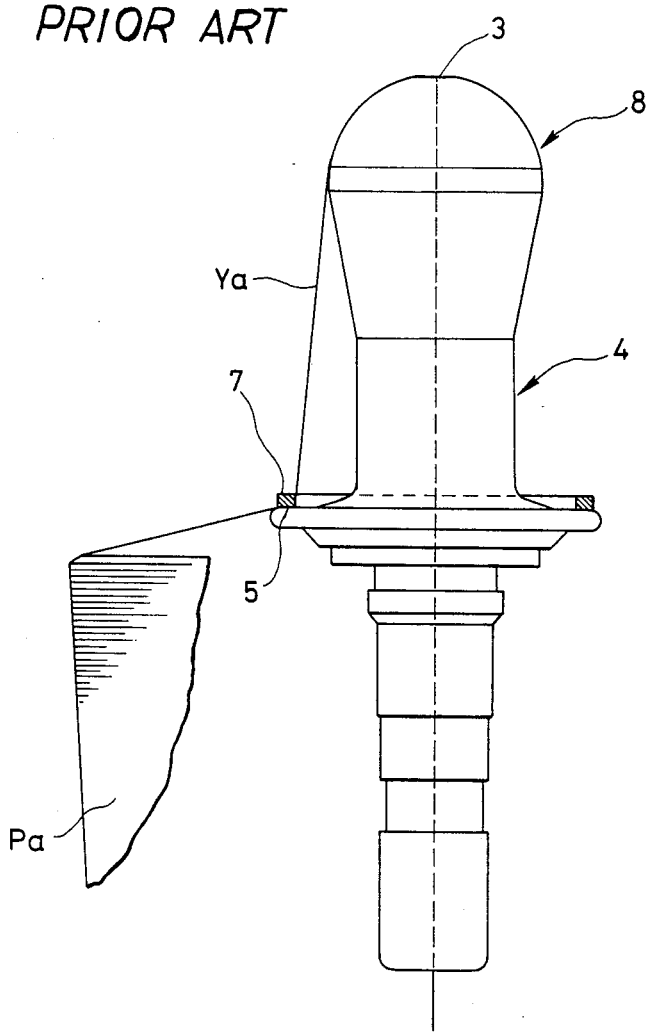
FIG. 2 PRIOR ART
FIG. 2 is a side elevational view of the conventional tenser body.
Figure 3:
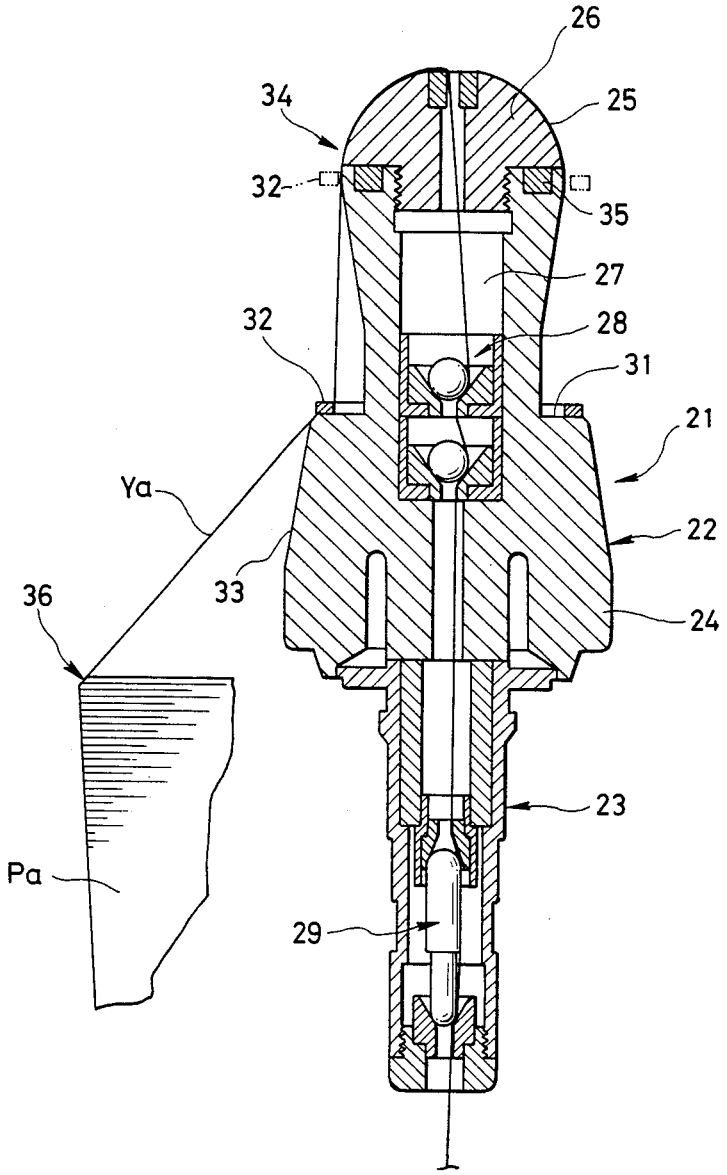
FIG. 3 is a vertical sectional view of a tenser body which employs a ring tenser according to the present invention.

A tenser body 21 according to the present invention as shown in FIG. 3 substantially corresponds to such a conventional tenser member 4 as shown in FIG. 2 and may be employed in a two for one twister as shown in FIG. 1. The tenser body 21 consists of an upper tenser part 22 and a lower tenser part 23 which are removably fitted one into another. A base portion 24 of the upper tenser part 22 is preferably made of a resin material and has a cap element 26 screwed into the top thereof. The cap element 26 may be made of a phenol resin material and has a substantially semispherical configuration. A yarn passing hole 27 for allowing a yarn Ya to pass therethrough is formed to extend through the center of each of the cap element 26, the base portion 24 and the lower tenser part 23. A ball tenser 28 is provided in the yarn passing hole 27 within the base portion 24 while a capsule tenser 29 is provided in the yarn passing hole 27 within the lower tenser part 23. The base portion 24 has a shoulder 31 formed on an outer circumferential surface thereof, and a ring 32 made of a metal material and having a certain weight is placed on the shoulder 32 of the base portion 24, thereby constituting a ring tenser. The shoulder 31 is formed substantially at the middle of the height of the base portion 24 and lies in a horizontal plane. Formed around the outer circumferential surface of the base portion 24 below the shoulder 31 is an inclined face 33 which is adapted to contact with an upper supply yarn Ya when the diameter of an upper package Pa is reduced to and below a prescribed value as winding operation proceeds. Above the shoulder 31, the diameter of the base portion 24 increases towards the top thereof such that the base portion 24 is contiguous to the semispherical top surface 25 of the cap element 26, thereby forming a larger diameter head portion 34. The ring 32 has a rather greater inner diameter than the outer diameter of a largest diameter portion of the head portion 34, that is, of a lowermost portion of the cap element 26 so as to allow the ring 32 to be readily fitted onto and removed from the base portion 24 of the tenser body 21. Meanwhile, the outer diameter is rather smaller than the outer diameter of the shoulder 31. A magnet 35 is embedded to extend along an outer periphery of that portion of the base portion 24 which corresponds to the largest diameter portion of the head portion 34 so that a magnetic attractive force may act on the ring 32. A range in which such an attractive force is effective may be selected such that, even if the ring 32 placed on the shoulder 31 as shown in FIG. 3 is caused to move or float by possible variation of the tension of a yarn Ya, the ring 32 is not held from being acted upon by the attractive force. However, it is to be understood that the attractive force is sufficiently strong to act upon and attract the ring 32 to hold the same from dropping from the tenser body 21 as shown in phantom in FIG. 3 if the tenser body 21 is put upside down.

As described hereinabove, the tenser device comprising the ring 32 and the tenser body 21 which has such a construction as described above may be used without any trouble similarly to the case of the conventional tenser body 4 as shown in FIG. 2. It is to be noted, however, that, different from the illustration in FIG. 3, this tenser body 21 additionally allows both an upper supply yarn Ya from an upper package Pa and a lower supply yarn from a lower package Pb to be unwound and drawn via the ring 32. In particular, while a conventional tenser member allows only an upper supply yarn Ya to be engaged with a ring 7 in order to attain equalized tension of upper and lower supply yarns, Ya and Yb, in the present tenser device, the location of the shoulder 31 is selected to be at a considerably high position above a rim 36 of an upper package Pa so as to reduce playable or floating movement of the ring 32 by the varying tension of the yarns Ya and Yb. Besides, the present tenser body 21 is designed to have an inclined face 33 which is adapted to be contacted over a specified length by the yarns Ya and Yb after the diameter of the upper package Pa has reduced to or below a predetermined value in order to apply predetermined tension to the yarns Ya and Yb. Accordingly, reduction to zero of a difference in tension between the yarns Ya and Yb when the diameter of the upper package Pa is smaller than the specified value is attained by controlling the difference in tension between the yarns Ya and Yb by means of the ring 32 which is allowed to floatingly move a minimized amount while both yarns Ya and Yb are contacted with the inclined face 33 to equalize drawing conditions of them as far as possible. By such an arrangement, the ring 32 can be freely mounted on or removed from the tenser body 21 without being disturbed by the lower supply yarn Yb even during doubling and twisting operations.

To sum up, according to the tenser device, firstly the ring 32 can be freely mounted on and removed from the tenser body 21 and, even if the tenser body 21 is inclined, it will not be readily dropped from the tenser member 21 by an action of the magnet 35, thereby facilitating handling of the system. Secondly, the tenser body 21 has the shoulder 31 formed at a rather high position and is provided with the inclined face 33 so that both yarns Ya and Yb may be engaged by the ring 32, thereby further facilitating assemling and disassembling of the ring 32.

It is to be noted that some kinds of yarns Ya and Yb might not necessitate the inclined face 33, and in such cases, the inclined face 33 may be replaced by a vertical face. Further, relations between the ring 32 and the magnet 35 can also be modified such that either the magnet 35 is replaced by a metal while the ring 32 is magnetized or the ring 32 is also magnetized in addition to the magnet 35. Additionally, the present invention can be applied not only to a two for one twister but also to a mere twisting machine and any other similar machine satisfactorily as a ring tenser therefor. Thus, the present invention is intended to cover all of such applications.

What is claimed is:

1. A tenser device for a twisting machine, comprising:

a lower tenser part, adapted to fit vertically within and to be supported by a package mounted on said twisting machine;

an upper tenser part, adapted to fit vertically over and to be supported by said lower tenser part, said upper tenser part being formed to have a base portion as a lower portion thereof, and a head portion vertically extending above said base portion;

a shoulder formed on an outer circumferential surface of said base portion at its uppermost elevation where said base portion and said head portion abut;

a metallic ring, configured to freely pass downwardly over said head portion so as to be capable of resting on said shoulder; and an annular magnet embedded within said head portion substantially at an uppermost vertical extent of said head portion;

whereby a yarn unwound from said package is passed generally upwardly between said ring and said shoulder, thereby applying tension to the yarn;

said magnet providing a magnetic field, interacting with said ring, of a strength sufficient to preclude said ring from falling from said head portion, when said tenser device is vertically inverted, by the weight of said ring acting under gravity.

2. A tenser device as claimed in claim 1, wherein said head portion is configured to have a truncated, inverted, vertically oriented, substantially conical shape, such that a smallest diameter portion of said head portion abuts said shoulder, and said magnet is embedded to extend along an outer periphery of said head portion having a largest diameter most removed from said shoulder.

3. A tenser device for a twisting machine, comprising:

a lower tenser part, adapted to fit vertically within and to be supported by a package mounted on said twisting machine;

an upper tenser part, adapted to fit vertically over and to be supported by said lower tenser part, said upper tenser part being formed to have a base portion as a lower portion thereof, and a head portion vertically extending above said base portion;

a shoulder formed on an outer circumferential surface of said base portion at its uppermost elevation where said base portion and said head portion abut;

a ring magnet, configured to freely pass downwardly over said head portion so as to be capable of resting on said shoulder; and an annular metallic element embedded within said head portion substantially at an uppermost vertical extent of said head portion;

whereby a yarn unwound from said package is passed generally upwardly between said ring magnet and said shoulder, thereby applying tension to the yarn;

said magnetic ring magnet providing a magnetic field, interacting with said annular metallic element, of a strength sufficient to preclude said ring magnet from falling from said head portion, when said tenser device is vertically inverted, by the weight of said ring magnet acting under gravity.

4. A tenser device as claimed in claim 3, wherein said head portion is configured to have a truncated, inverted, vertically oriented, substantially conical shape, such that a smallest diameter portion of said head portion abuts said shoulder, and said annular metallic element is embedded to extend along an outer periphery of said head portion having a largest diameter most removed from said shoulder.

5. A tenser device as claimed in claim 1, 2, 3 or 4, further comprising:

a cap element screwed into the top of the head portion; and a yarn passing hole, formed to extend substantially axially vertically downward through each of said cap element, said upper tenser part, and said lower tenser part;

wherein said yarn passing generally upwardly between said ring and said shoulder is thence directed into said yarn passing hole and downwardly through said cap element, said upper tenser part, and said lower tenser part.

6. A tenser device as claimed in claim 5, wherein said shoulder is formed such that said head portion extends upwardly from said shoulder by a vertical dimension substantially equal to the vertical extent of said base portion, said shoulder being disposed in a substantially horizontal plane.

7. A tenser device as claimed in claim 6, further comprising an inclined face formed around an outer circumferential surface of the base portion, such that the base portion increases in diameter downwardly from the shoulder, the angle of inclination of the inclined face being adapted such that said yarn being unwound from said package will contact said inclined face when the diameter of the package is reduced.

8. A tenser device as claimed in claim 7, wherein the cap element has a substantially semispherical configuration having a diameter substantially equal to the diameter of uppermost end of said head portion, thereby providing a substantially contiguous external surface between the cap element and the head portion.

9. A tenser device as claimed in claim 8, wherein the ring has an inner diameter greater than the maximum diameter of the head portion, and said ring has an outer diameter substantially equal to the diameter of said base portion at said shoulder.

10. A tenser device as claimed in claim 9, further comprising:

at least one ball tenser, disposed within the yarn passing hole of the base portion of said upper tenser part; and a capsule tenser, disposed within the yarn passing hole of the lower tenser part.

11. A tenser device as claimed in claim 8, further comprising:

at least one ball tenser, disposed within the yarn passing hole of the base portion of said upper tenser part; and a capsule tenser, disposed within the yarn passing hole of the lower tenser part.

12. A tenser device as claimed in claim 7, wherein a lower portion of the base portion of the upper tenser part is formed to have a vertically oriented right circular cylindrical face.

13. A tenser device as claimed in claim 12, further comprising:

at least one ball tenser, disposed within the yarn passing hole of the base portion of said upper tenser part; and a capsule tenser, disposed within the yarn passing hole of the lower tenser part.

14. A tenser device as claimed in claim 7, further comprising:

a least one ball tenser, disposed within the yarn passing hole of the base portion of said upper tenser part; and a capsule tenser, disposed within the yarn passing hole of the lower tenser part.

15. A tenser device as claimed in claim 6, further comprising:

at least one ball tenser, disposed within the yarn passing hole of the base portion of said upper tenser part; and a capsule tenser, disposed within the yarn passing hole of the lower tenser part.

16. A tenser device as claimed in claim 5, further comprising:

at least one ball tenser, disposed within the yarn passing hole of the base portion of said upper tenser part; and a capsule tenser, disposed within the yarn passing hole of the lower tenser part.

* * * * *